US010150197B2

(12) United States Patent
Xue et al.

(10) Patent No.: US 10,150,197 B2
(45) Date of Patent: Dec. 11, 2018

(54) COMPOSITE WHEEL DEBURRING DEVICE

(71) Applicant: CITIC Dicastal CO., LTD, Qinhuangdao (CN)

(72) Inventors: Bowen Xue, Qinhuangdao (CN); Jiandong Guo, Qinhuangdao (CN)

(73) Assignee: CITIC DICASTAL CO., LTD (CN)

( * ) Notice: Subject to any disclaimer, the term of this patent is extended or adjusted under 35 U.S.C. 154(b) by 55 days.

(21) Appl. No.: 15/364,322

(22) Filed: Nov. 30, 2016

(65) Prior Publication Data

US 2017/0182614 A1 Jun. 29, 2017

(30) Foreign Application Priority Data

Dec. 29, 2015 (CN) ..... 2015 1 100654

(51) Int. Cl.

| | |
|---|---|
| ***B24B 9/04*** | (2006.01) |
| ***B24B 5/12*** | (2006.01) |
| ***B24B 5/44*** | (2006.01) |
| ***B24B 41/02*** | (2006.01) |
| ***B24B 19/00*** | (2006.01) |
| ***B24B 41/00*** | (2006.01) |
| ***B24B 41/06*** | (2012.01) |

(52) U.S. Cl.

CPC ..... *B24B 9/04* (2013.01); *B24B 5/12* (2013.01); *B24B 5/44* (2013.01); *B24B 19/00* (2013.01); *B24B 41/00* (2013.01); *B24B 41/005* (2013.01); *B24B 41/02* (2013.01); *B24B 41/06* (2013.01)

(58) Field of Classification Search

CPC .... B24B 5/12; B24B 5/44; B24B 9/04; B24B 19/00; B24B 41/00; B24B 41/005; B24B 41/02; B24B 41/06

USPC ..... 451/178, 190

See application file for complete search history.

(56) References Cited

U.S. PATENT DOCUMENTS

| | | | | |
|---|---|---|---|---|
| 3,258,804 A * | 7/1966 | Fowle | B24B 5/225 15/104.011 |
| 4,216,560 A * | 8/1980 | Schmidt | B24B 41/06 15/268 |
| 2013/0102233 A1* | 4/2013 | Cheon | B24B 27/033 451/331 |

FOREIGN PATENT DOCUMENTS

| | | | |
|---|---|---|---|
| CN | 203438027 | * | 2/2014 |
| JP | 3044289 B2 | * | 5/2000 |
| JP | 3091417 B2 | * | 9/2000 |

* cited by examiner

*Primary Examiner* — Eileen Morgan

(74) *Attorney, Agent, or Firm* — Calfee, Halter & Griswold LLP

(57) ABSTRACT

The present invention relates to a composite wheel deburring device, which is composed of a stand, servo motors, guide rails, a first brush system, a second brush system, and a synchronous clamping rotary system. During use, the first servo motor drives first brush to rotate, and a second servo motor drives a second brush to rotate; the second brush starts to remove rim corner burrs at flanges of the wheel; right servo electric cylinder enables the first brush to move to an appropriate position, and jacking cylinder enables the first brush to perpendicularly come in contact with window rim corners at the roots of the flanges by a second guide rail, so that rim corner burrs at the position can be well removed; and upper servo electric cylinder adjusts the angle of the second brush to an appropriate angle, so that rim corner burrs of wheel rims are removed.

1 Claim, 3 Drawing Sheets

COMPOSITE WHEEL DEBURRING DEVICE

CROSS-REFERENCE TO RELATED APPLICATIONS

This application claims priority to Chinese Patent Application No. 201511006541.6, filed on Dec. 29, 2015, which is hereby incorporated by reference in its entirety.

TECHNICAL FIELD

The present invention relates to a deburring device, and in particular to an on-line composite wheel deburring device.

BACKGROUND ART

For manufacturing enterprises of aluminum alloy wheels, deburring is an important link after machining procedures. If sharp corners and burrs on a wheel cannot be well removed, positions where the sharp corners and the burrs are formed can be very quickly corroded when wheels are used, so that appearance effect is directly influenced. At current, nearly all of wheel manufacturing enterprises adopt special deburring equipment in which an upper circular brush and a lower circular brush are used for deburring a back cavity and a front side; such a manner has an acceptable effect on the wheels with simple front shapes, but has poor deburring effect on the wheels with complicated shapes; some positions which are difficult to debur need hand burnishing, so that not only is the labour intensity of workers increased, the production efficiency is reduced, but also the unit production cost of the wheels is increased. The deburring principle described in the present invention is suitable for wheels with various shapes, is high in deburring efficiency and high in generality.

SUMMARY OF THE INVENTION

An object of the present invention is to provide a composite wheel deburring device which can perform emphasis treatment on rim corner burrs at roots of flanges of wheels with any shapes, and rim corner burrs at roots of wheel rims.

To achieve the object described above, a technical solution of the present invention is as follows: a composite wheel deburring device comprises a brush system I, a brush system II and a synchronous clamping rotary system.

Four guide pillars are fixed under a the first lifting plate, four guide sleeves matched with the four guide pillars are fixed on a bottom plate, and output ends of two lifting cylinders which are also fixed on the bottom plate are hinged to positions under the first lifting plate.

The first brush system comprises a right sliding plate frame, an upright plate, a second guide rail, a jacking cylinder, a second lifting plate, a first belt wheel, a first servo motor, a first synchronous belt, a screw rod, nuts, a left sliding table, a first brush, a first shaft, a second belt wheel, and a right servo electric cylinder, wherein the right sliding plate frame is mounted above the first lifting plate through first guide rail; the upright plate is fixed on the right sliding plate frame; one end of a sliding rail of the second guide rail is fixed under the second lifting plate, and a sliding block is fixed on the upright plate; the jacking cylinder is fixed on the top end of the upright plate, and an output end of the jacking cylinder is connected with a position under the second lifting plate; the first servo motor of which an output end is provided with the first belt wheel is fixed at the lower end of the second lifting plate; the first shaft on which both the first brush and the second belt wheel are fixed is mounted at the top end of the second lifting plate through a bearing; the belt I is connected with the second belt wheel through the first synchronous belt; and the right servo electric cylinder is fixed on the right side of the first lifting plate, and an output end of the right servo electric cylinder is connected with the right sliding plate frame.

The synchronous clamping rotary system comprises first bearing base, second shaft, V-shaped rollers, a right sliding table, a driving electric machine, third belt wheel, a second synchronous belt, a fourth belt wheel, a fifth belt wheel, a third synchronous belt, a pneumatic motor, a sixth belt wheel, cushion blocks, and a fourth guide rail, wherein nuts are respectively fixed under the left sliding table and the right sliding table, and the screw rod matched with the nuts is fixed on a platform of a stand; the fifth belt wheel is mounted at the tail end of the screw rod; the pneumatic motor of which an output end is provided with the sixth belt wheel is fixed on the bottom plate; the fifth belt wheel and the sixth belt wheel are connected through the third synchronous belt; the two first bearing base are respectively fixed above the left sliding table and the right sliding table; the four second shaft are mounted in the first bearing base through bearings, and the V-shaped rollers are fixed at upper ends of the second shaft; the two third belt wheel are respectively fixed at lower ends of the two second shaft under the right sliding table; the driving motor of which an output end is fixedly provided with the fourth belt wheel is mounted above the right sliding table; the third belt wheel and the fourth belt wheel are connected through the second synchronous belt; the left sliding table and the right sliding table are mounted on two sides of the platform at the upper part of the stand through the cushion blocks and the fourth guide rail.

The second brush system comprises lifting cylinders, a left sliding plate frame, a third guide rail, a sliding block, an upper servo electric cylinder, a lower servo electric cylinder, a turnover plate, a seventh belt wheel, a second servo motor, a fourth synchronous belt, a connecting rod, a second brush, a second bearing base, second shaft, and an eighth belt wheel, wherein the left sliding plate frame is mounted above the the first lifting plate through the first guide rail; the lower servo electric cylinder is fixed on the left side of the first lifting plate, and an output end of the lower servo electric cylinder is connected with the left sliding plate frame; the sliding block is mounted above the left sliding plate frame through the third guide rail, the upper servo electric cylinder is fixed above the left sliding plate frame, and an output end of the upper servo electric cylinder is connected with the sliding block; the turnover plate is hinged above the left sliding plate frame; the second servo motor is mounted under the turnover plate, and the seventh belt wheel is fixed at an output end of the second servo motor; the third shaft on which the second brush and the eighth belt wheel are fixed is mounted in the second bearing base above the turnover plate through a bearing; the seventh belt wheel is connected with the eighth belt wheel through the fourth synchronous belt; and the connecting rod is hinged between the turnover plate and the sliding block.

Two elevating cylinders on which supporting plates are respectively fixed are fixed at corresponding positions of the platform at the upper part of the stand, and two conveyor belts are also fixed at corresponding positions of the platform at the upper part of the stand.

During actual use, the conveyor belts enable a wheel to reach middle positions of the four V-shaped rollers, the elevating cylinders lift the wheel, and the pneumatic motor drives the screw rod to rotate, so that the left sliding table and the right sliding table drive the four V-shaped rollers to synchronously clamp the wheel, and the driving motor realizes rotation of the wheel under the clamped state; the first servo motor drives the first brush to rotate, and the second servo motor drives the second brush to rotate; the lifting cylinders lift the brushes through the four guide pillars; when the two brushes come in contact with flange rim corner of the wheel, certain pressure is applied, and the second brush starts to remove rim corner burrs at flanges of the wheel; besides, the right servo electric cylinder enables the first brush to move to an appropriate position, and the jacking cylinder enables the first brush to perpendicularly come in contact with window rim corners at roots of the flanges by a second guide rail, so that rim corner burrs at the position can be well removed; an upper servo electric cylinder adjusts the angle of the second brush to an appropriate angle, so that rim corner burrs of wheel rims are removed.

During use, emphasis treatment can be performed on the rim corner burrs at the roots of the flanges of the wheel with various shapes and the rim corner burrs at the roots of the wheel rims, so that hand burnishing on the burrs at the window is completely replaced, the labor intensity of workers is greatly reduced, and the production cost is reduced; besides, the deburring device has the characteristics of being simple in structure, high in automation degree, advanced in technology, high in generality, high in efficiency and safe and stable in performance.

Figure 1:
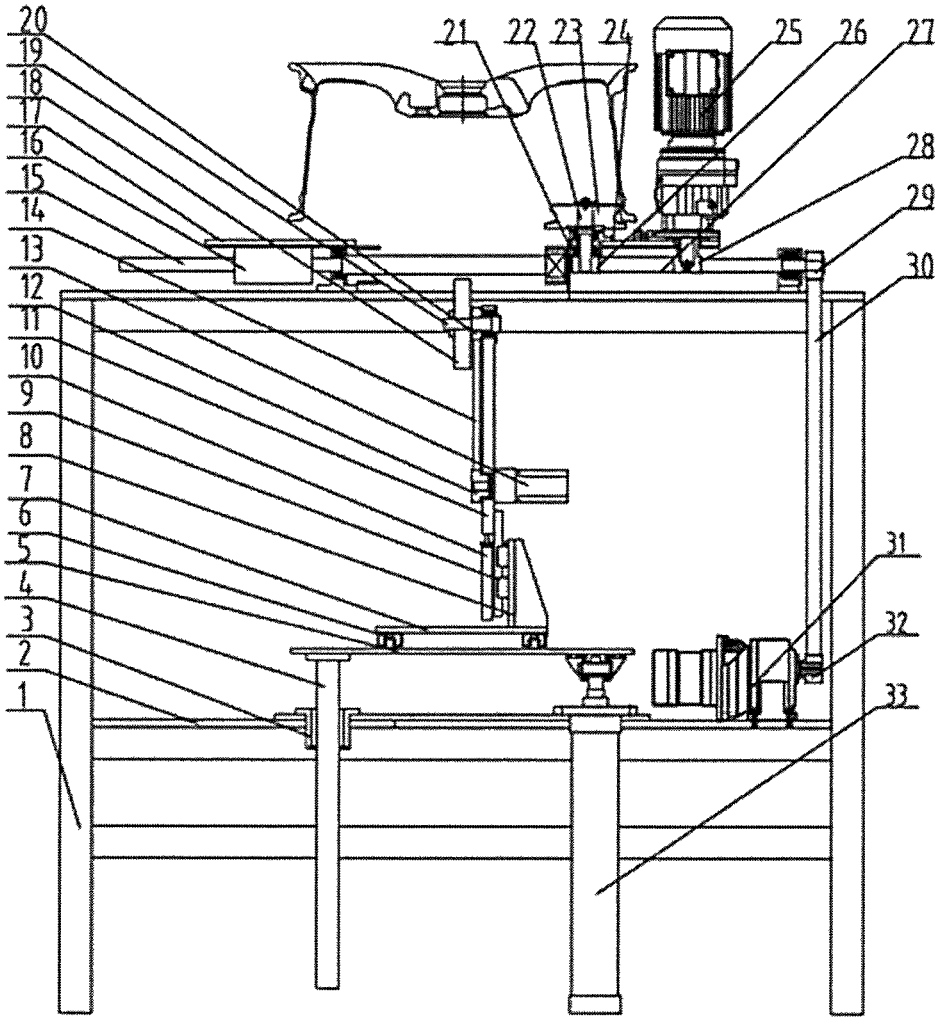
FIG. 1 is a front view of a composite wheel deburring device.
Figure 2:
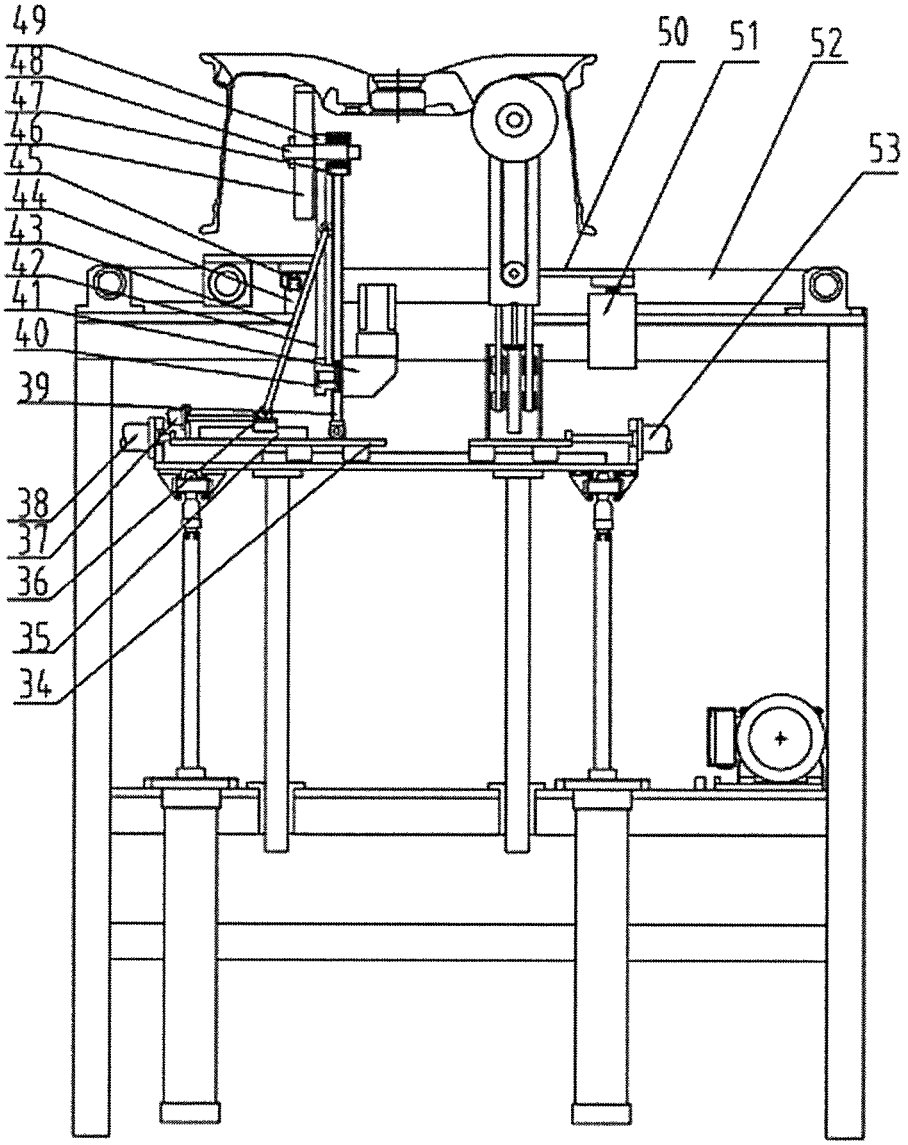
FIG. 2 is a left view of a composite wheel deburring device used for removing rim corner burrs at roots of flanges.
Figure 3:
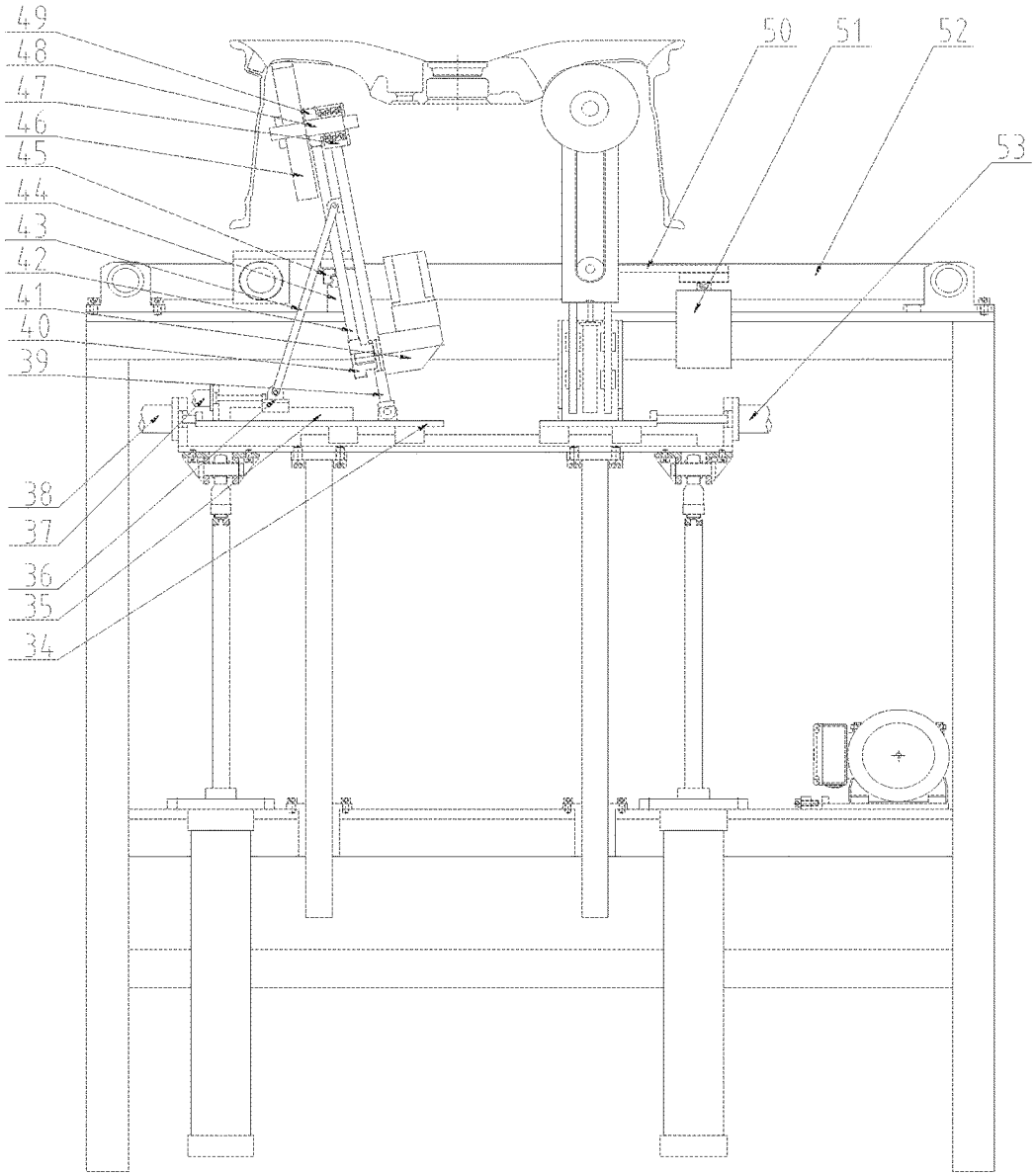
FIG. 3 is a left view of a composite wheel deburring device used for removing rim corner burrs at roots of wheel rims.

In the figure, numeric symbols are as follows: 1—stand, 2—bottom plate, 3—guide sleeve, 4—guide pillar, 5—first lifting plate, 6—first guide rail, 7—right sliding plate frame, 8—upright plate, 9—second guide rail, 10—jacking cylinder, 11—second lifting plate, 12—first belt wheel, 13—first servo motor, 14—first synchronous belt, 15—screw rod, 16—nut, 17—left sliding table, 18—first brush, 19—first shaft, 20—second belt wheel, 21—first bearing base, 22—second shaft, 23—V-shaped roller, 24—right sliding table, 25—driving motor, 26—third belt wheel, 27—second synchronous belt, 28—fourth belt wheel, 29—fifth belt wheel, 30—third synchronous belt, 31—pneumatic motor, 32—sixth belt wheel, 33—lifting cylinder, 34—left sliding plate frame, 35—third guide rail, 36—sliding block, 37—upper servo electric cylinder, 38—lower servo electric cylinder, 39—turnover plate, 40—seventh belt wheel, 41—second servo motor, 42—fourth synchronous belt, 43—connecting rod, 44—cushion block, 45—fourth guide rail, 46—second brush, 47—second bearing base, 48—third shaft, 49—eighth belt wheel, 50—supporting plate, 51—elevating cylinder, 52—conveyor belt, and 53—right servo electric cylinder.

DETAILED DESCRIPTION OF THE INVENTION

In the following, the details and working conditions of a specific device provided by the present invention are described in detail in combination with figures.

The composite wheel deburring device comprises a brush system I, a brush system II, and a synchronous clamping rotary system.

Four guide pillars 4 are fixed under a first lifting plate 5, four guide sleeves 3 matched with the four guide pillars 4 are fixed on a bottom plate 2, and output ends of two lifting cylinders 33 which are also fixed on the bottom plate 2 are hinged to positions under the first lifting plate 5.

The first brush system comprises a right sliding plate frame 7, an upright plate 8, a second guide rail 9, a jacking cylinder 10, a second lifting plate 11, a first belt wheel 12, a first servo motor 13, a first synchronous belt 14, a screw rod 15, nuts 16, a left sliding table 17, a first brush 18, a first shaft 19, a second belt wheel 20 and a right servo electric cylinder 53, wherein the right sliding plate frame 7 is mounted above the first lifting plate 5 through first guide rail 6; the upright plate 8 is fixed on the right sliding plate frame 7; one end of a sliding rail of the second guide rail 9 is fixed under the second lifting plate 11, and a sliding block is fixed on the upright plate 8; the jacking cylinder 10 is fixed at the top end of the upright plate 8, and an output end of the jacking cylinder is connected with a position under the second lifting plate 11; the first servo motor 13 of which an output end is provided with the first belt wheel 12 is fixed at the lower end of the second lifting plate 11; the first shaft 19 on which both the first brush 18 and the second belt wheel 20 are fixed is mounted at the top end of the second lifting plate 11 through a bearing; the first belt wheel is 12 connected with the second belt wheel 20 through the first synchronous belt 14; and the right servo electric cylinder 53 is fixed on the right side of the first lifting plate 5, and an output end of the right servo electric cylinder 53 is connected with the right sliding plate frame 7.

The synchronous clamping rotary system comprises first bearing base 21, second shaft 22, V-shaped rollers 23, a right sliding table 24, a driving motor 25, third belt wheel 26, a second synchronous belt 27, a fourth belt wheel 28, a fifth belt wheel 29, a third synchronous belt 30, a pneumatic motor 31, a sixth belt wheel 32, cushion blocks 44, and a fourth guide rail 45, wherein nuts 16 are respectively fixed under the left sliding table 17 and the right sliding table 24, and the screw rod 15 matched with the nuts 16 is fixed on a platform of a stand 1; the fifth belt wheel 29 is mounted at the tail end of the screw rod 15; the pneumatic motor 31 of which an output end is provided with the sixth belt heel 32 is fixed on the bottom plate 2; the fifth belt wheel 29 and the sixth belt wheel 32 are connected through the third synchronous belt 30; the two first bearing base 21 are respectively fixed above the left sliding table 17 and the right sliding table 24; the four second shaft 22 are mounted in the first bearing base 21 through bearings, and the V-shaped rollers 23 are fixed at upper ends of the second shaft 22; the two third belt wheel (26) are respectively fixed at lower ends of the two second shaft (22) under the right sliding table (24); the driving motor of which an output end is fixedly provided with the fourth belt wheel (28) is mounted above the right sliding table (24); the third belt wheel 26 and the fourth belt wheel 28 are connected through the second synchronous belt 27; the left sliding table 17 and the right sliding table 24 are mounted on two sides of the platform at the upper part of the stand 1 through the cushion blocks 44 and the fourth guide rail 45.

The second brush system comprises lifting cylinders 33, a left sliding plate frame 34, a third guide rail 35, a sliding block 36, an upper servo electric cylinder 37, a lower servo electric cylinder 38, a turnover plate 39, a seventh belt wheel 40, a second servo motor 41, a fourth synchronous belt 42, a connecting rod 43, a second brush 46, a second bearing base 47, a third shaft 48 and a eighth belt wheel 49, wherein the left sliding plate frame 34 is mounted above the first lifting plate 5 through the first guide rail 6, the lower servo electric cylinder 38 is fixed on the left side of the first lifting plate 5, and an output end of the lower servo electric cylinder 38 is connected with the left sliding plate frame 34; the sliding block 36 is mounted above the left sliding plate frame 34 through the third tide rail 35, the upper servo electric cylinder 37 is fixed above the left sliding plate frame 34, and an output end of the upper servo electric cylinder 37 is connected with the sliding block 36; the turnover plate 39 is hinged above the left sliding plate frame 34; the second servo motor 41 is mounted under the turnover plate 39, and the seventh belt wheel 40 is fixed at an output end of the second servo motor 41; the third shaft 48 on which both the second brush 46 and the eighth belt wheel 49 are fixed is mounted in the second bearing base 47 above the turnover plate 39 through a bearing; the seventh belt wheel 40 is connected with the eighth belt wheel 49 through the fourth synchronous belt 42; and the connecting rod 43 is hinged between the turnover plate 39 and the sliding block 36.

Two elevating cylinders 51 on which supporting plates 50 are respectively fixed are fixed at corresponding positions of the platform at the upper part of the stand 1, and two conveyor belts 52 are also fixed at corresponding positions of the platform at the upper part of the stand 1.

During actual use, the conveyor belts enable a wheel to reach middle positions of the four V-shaped rollers, the elevating cylinders lift the wheel, and the pneumatic motor drives the screw rod to rotate, so that the left sliding table and the right sliding table drive the four V-shaped rollers to synchronously clamp the wheel, and the driving motor realizes rotation of the wheel under the clamped state; the first servo motor drives the first brush to rotate, and the second servo motor drives the second brush to rotate; the lifting cylinders lift the brushes through the four guide pillars; when the two brushes come in contact with flange rim corner of the wheel, certain pressure is applied, and the second brush starts to remove rim corner burrs at flanges of the wheel; besides, the right servo electric cylinder enables the first brush to move to an appropriate position, and the jacking cylinder enables the first brush to perpendicularly come in contact with window rim corners at roots of the flanges, so that rim corner burrs at the position can be well removed; the upper servo electric cylinder adjusts the angle of the second brush to an appropriate angle, so that rim corner burrs of wheel rims are removed.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A composite wheel deburring device, comprising a first brush system, a second brush system and a synchronous clamping rotary system, and characterized in that:

four guide pillars are fixed under a first lifting plate, four guide sleeves matched with the four guide pillars are fixed on a bottom plate, and output ends of two lifting cylinders which are also fixed on the bottom plate are hinged to positions under the first lifting plate;

the first brush system comprises a right sliding plate frame, an upright plate, a second guide rail, a jacking cylinder, a second lifting plate, a first belt wheel, a first servo motor, a first synchronous belt, a screw rod, nuts, a left sliding table, a first brush, a first shaft, a second belt wheel, and a right servo electric cylinder, wherein the right sliding plate frame is mounted above the first lifting plate through first guide rail; the upright plate is fixed on the right sliding plate frame; one end of a sliding rail of the second guide rail is fixed under the second lifting plate, and a sliding block is fixed on the upright plate; the jacking cylinder is fixed at the top end of the upright plate, and an output end of the jacking cylinder is connected with a position under the second lifting plate; the first servo motor of which an output end is provided with the first belt wheel is fixed at the lower end of the second lifting plate; the first shaft on which both the first brush and the second belt wheel are fixed is mounted at the top end of the second lifting plate through a bearing; the first belt wheel is connected with the second belt wheel through the first synchronous belt; and the right servo electric cylinder is fixed on the right side of the first lifting plate, and an output end of the right servo electric cylinder is connected with the right sliding plate frame;

the synchronous clamping rotary system comprises first bearing base, second shaft, V-shaped rollers, a right sliding table, a driving motor, third belt wheel, a second synchronous belt, a fourth belt wheel, a fifth belt wheel, a third synchronous belt, a pneumatic motor, a sixth belt wheel, cushion blocks, and a fourth guide rail, wherein nuts are respectively fixed under the left sliding table and the right sliding table, and the screw rod matched with the nuts is fixed on a platform of a stand; the fifth belt wheel is mounted at the tail end of the screw rod; the pneumatic motor of which an output end is provided with the sixth belt wheel is fixed on the bottom plate; the fifth belt wheel and the sixth belt wheel are connected through the third synchronous belt; the two first bearing base are respectively fixed above the left sliding table and the right sliding table; the four second shaft are mounted in the first bearing base through bearings, and the V-shaped rollers are fixed at upper ends of the second shaft; the two third belt wheel are respectively fixed at lower ends of the two second shaft under the right sliding table; the driving motor of which an output end is fixedly provided with the fourth belt wheel is mounted above the right sliding table; the third belt wheel and the fourth belt wheel are connected through the second synchronous belt; the left sliding table and the right sliding table are mounted on two sides of the platform at the upper part of the stand through the cushion blocks and the fourth guide rail;

the first brush system comprises lifting cylinders, a left sliding plate frame, a third guide rail, a sliding block, an upper servo electric cylinder, a lower servo electric cylinder, a turnover plate, a seventh belt wheel, a second servo motor, a fourth synchronous belt, a connecting rod, a second brush, a second bearing base, a third shaft and a eighth belt wheel, wherein the left sliding plate frame is mounted above the first lifting plate through the first guide rail, and the lower servo electric cylinder is fixed on the left side of the first lifting plate, and an output end of the lower servo electric cylinder is connected with the left sliding plate frame; the sliding block is mounted above the left sliding plate frame through the third guide rail, the upper servo electric cylinder is fixed above the left sliding plate frame, and an output end of the upper servo electric cylinder is connected with the sliding block; the turnover plate is hinged to a position above the left sliding plate frame; the second servo motor is mounted under the turnover plate, and the seventh belt wheel is fixed at an output end of the second servo motor; the third shaft on which the second brush and the eighth belt wheel are fixed is mounted in the second bearing base above the turnover plate through a bearing; the seventh belt wheel is connected with the eighth belt wheel through the fourth synchronous belt; and the connecting rod is hinged between the turnover plate and the sliding block;

two elevating cylinders on which supporting plates are respectively fixed are fixed at corresponding positions of the platform at the upper part of the stand, and two conveyor belts are also fixed at corresponding positions of the platform at the upper part of the stand by conveying rollers; and during actual use, the conveyor belts enable a wheel to reach middle positions of the four V-shaved rollers, the elevating cylinders lift the wheel, and the pneumatic motor drives the screw rod to rotate, so that the left sliding table and the right sliding table drive the four V-shaped rollers to synchronously clamp the wheel, and the driving motor realizes rotation of the wheel under the clamped state; the first servo motor drives the first brush to rotate, and the second servo motor drives the second brush to rotate; the lifting cylinders lift the brushes through the four guide pillars; when the two brushes come in contact with flange rim corner of the wheel, certain pressure is applied, and the second brush starts to remove rim corner burrs at flanges of the wheel; besides, the right servo electric cylinder enables the first brush to move to an appropriate position, and the jacking cylinder enables the first brush to perpendicularly come in contact with window rim corners at roots of the flanges, so that rim corner burrs at the position can be well removed; the upper servo electric cylinder adjusts the angle of the second brush to an appropriate angle, so that rim corner burrs of wheel rims are removed.

* * * * *